US006865920B2

(12) United States Patent
Kondo et al.

(10) Patent No.: US 6,865,920 B2
(45) Date of Patent: Mar. 15, 2005

(54) INDIRECT EXTRUSION METHOD OF CLAD MATERIAL

(75) Inventors: Hideyuki Kondo, Nagoya (JP); Hideo Sano, Tokyo (JP); Toshiaki Doi, Tokyo (JP)

(73) Assignee: Sumitomo Light Metal Industries, Ltd, Tokyo (JP)

( * ) Notice: Subject to any disclaimer, the term of this patent is extended or adjusted under 35 U.S.C. 154(b) by 17 days.

(21) Appl. No.: 10/260,580

(22) Filed: Sep. 27, 2002

(65) Prior Publication Data

US 2003/0066328 A1 Apr. 10, 2003

(30) Foreign Application Priority Data

Oct. 1, 2001 (JP) ..... 2001-305224

(51) Int. Cl.[7] ..... B21C 23/00
(52) U.S. Cl. ..... 72/273.5; 72/258
(58) Field of Search ..... 72/258, 260, 264, 72/272, 273.5

(56) References Cited

U.S. PATENT DOCUMENTS

| | | | | |
|---|---|---|---|---|
| 3,503,243 A | * | 3/1970 | Katz | 72/258 |
| 3,791,183 A | * | 2/1974 | Creuzet | 72/46 |
| 3,837,066 A | * | 9/1974 | Mori et al. | 29/599 |
| 4,462,234 A | | 7/1984 | Fiorentino et al. | 72/41 |
| 4,494,448 A | * | 1/1985 | Eystratov et al. | 92/172 |
| 5,964,117 A | * | 10/1999 | Holroyd et al. | 72/258 |

FOREIGN PATENT DOCUMENTS

| | | | | |
|---|---|---|---|---|
| FR | 2 551 682 | | 3/1985 | B21C/23/22 |
| GB | 1 600 519 | | 10/1981 | B21C/23/22 |
| JP | 3-138017 | * | 6/1991 | 72/258 |
| JP | 5-309411 | * | 11/1993 | 72/258 |
| JP | 09-201618 | | 1/1996 | |

OTHER PUBLICATIONS

Sano, Hideo, Takashi Ishikawa and Yoshinori Yoshida, "Study on Metal Flow in Extruded Billet", pp. 47–53.
"The Method of Indirect Extrusion," The Furukawa Electric Review, No. 70; Jul. 1980, pp. 85–91.

* cited by examiner

*Primary Examiner*—Ed Tolan
(74) *Attorney, Agent, or Firm*—Davis & Bujold, P.L.L.C.

(57) ABSTRACT

A clad billet 120 has a core material 122 of which outer surface is coated by a coating material 124. A circular front plate 126 is provided at the head of the clad billet 120. The front plate 126 is made of the same material as the coating material 124. As the clad billet 120 is extruded, the front plate 126 first flows out. Accordingly, instead of the core material 122, the front plate 126 forms dead metal. Moreover, since this front plate 126 is made of the same material as the coating material 124, a defective clad such as a three layer clad are not formed. Also, since a billet thrusting face 102*a* is tapered toward an axis A of a die at an angle of 55–85 degrees, the volume of dead metal itself is reduced, and therefore it is possible to flow out the defective clad, even if it is generated, at an early stage of extrusion.

9 Claims, 10 Drawing Sheets

120
122
124

120
122
124
124a
126a
126
DIRECTION OF EXTRUSION

PRIOR ART

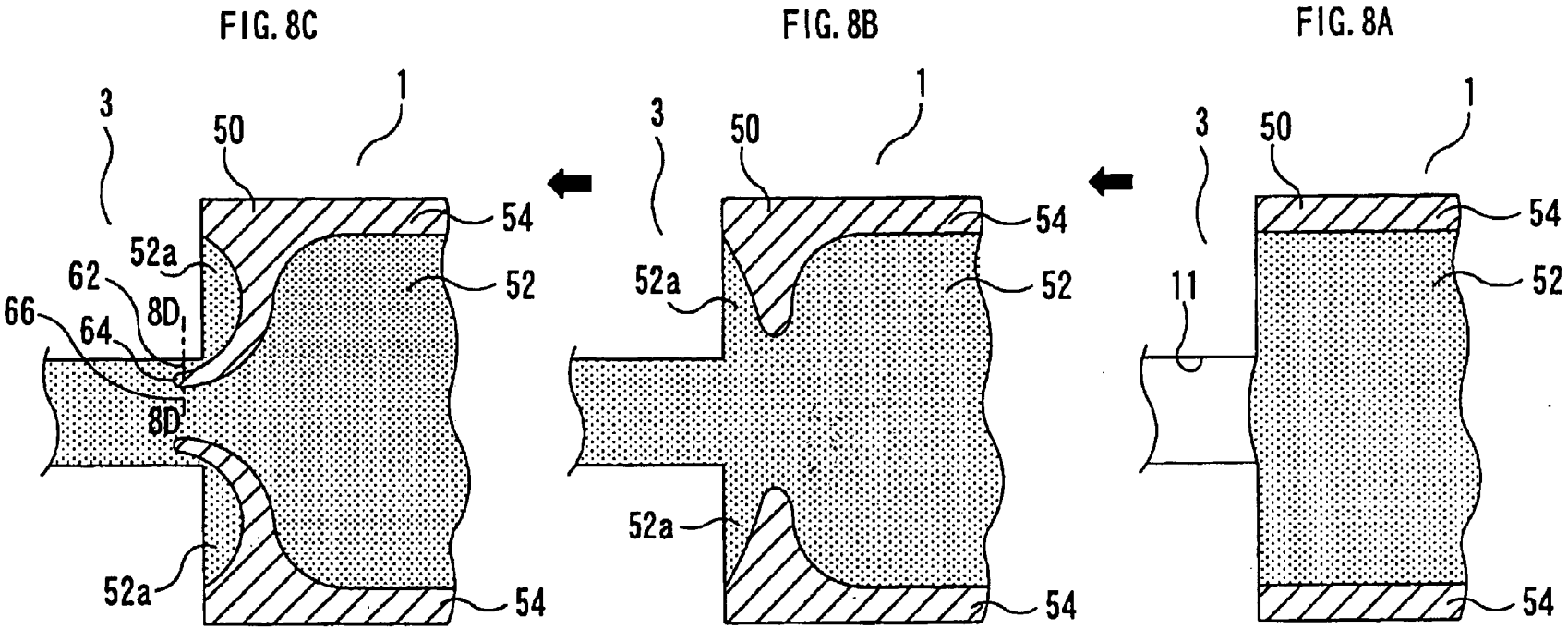
FIG. 8A
FIG. 8B
FIG. 8C
1
3
50
52
54
52a
11
62
64
66
8D
8D1
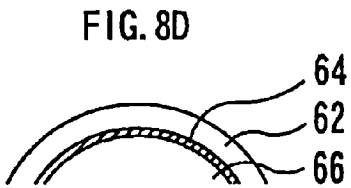
FIG. 8D
64
62
66

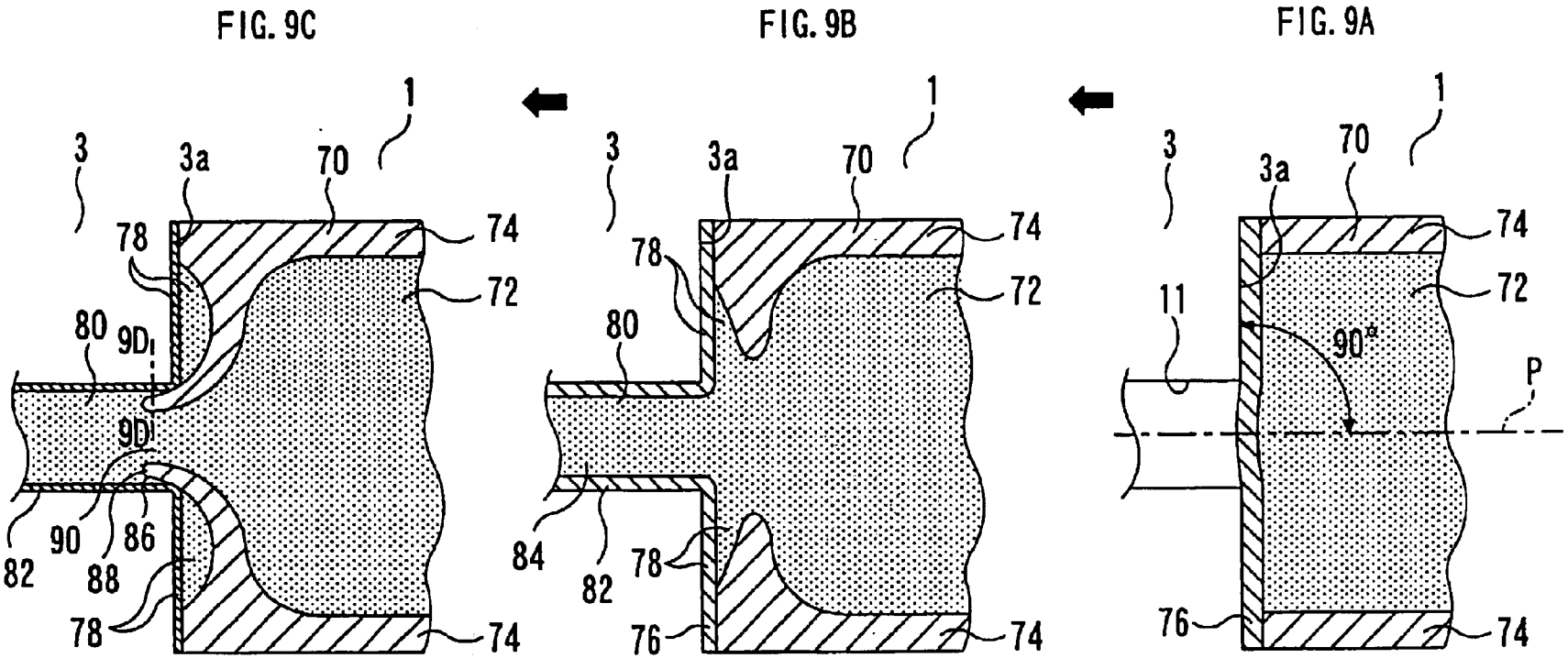
FIG. 9A
FIG. 9B
FIG. 9C
1
3
3a
70
72
74
76
78
80
82
84
86
88
90
90°
P
11
9D1
9D2
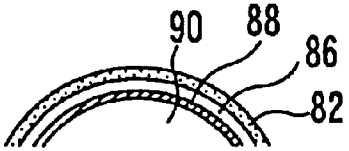
FIG. 9D
90
88
86
82

INDIRECT EXTRUSION METHOD OF CLAD MATERIAL

BACKGROUND OF THE INVENTION i) Field of the Invention

This invention relates to a method for manufacturing a clad material by means of indirect extrusion.

ii) Description of the Related Art

As shown in FIG. 7, for example, when conventional indirect extrusion processing is performed, an extrusion tool comprised of a die 3 for defining an outer shape of a product and a mandrel 4 for defining an inner shape of the product is installed inside a container 1, and a billet 2 is set inside the container 1 and thrust against a loose dummy 6. This conventional method of indirect extrusion is disclosed in the Unexamined Japanese Patent Publication No. 9-201618.

In this case, the loose dummy 6 is stationary, and the die 3 and the mandrel 4 are forced together to move relatively toward the billet 2 (more particularly, toward the loose dummy 6) set inside the container 1. Then, the billet 2 is extruded through a die opening 11 into a product shape to form an extruded material 10.

In such a processing method by means of indirect extrusion, the billet 2 is not moved with regard to the container 1, and no friction is generated between an inner wall of the container 1 and the billet 2. Accordingly, less formation of dead metal is achieved, and thus the method has been in the limelight in the field of manufacturing of extruded products with high precision.

Although the above example is for indirect extrusion of a tube, indirect extrusion of a stick (solid material) can be also performed in the same manner only by removing the mandrel 4.

When a clad billet composed of a core material and a coating material undergoes indirect extrusion according to the aforementioned prior art technique, however, dead metal composed of the core material is formed, though it is little, and the core material in the dead metal is extruded as a surface layer of the product at an early stage of extrusion. Accordingly, a defective clad called three-layer clad is formed which is composed of the core material, coating material and core material in layers.

In other words, referring first to FIG. 8A, a die 3 is forced to move relatively toward a billet 50 which is set inside the container 1 and composed of a core material 52 and a coating material 54 coating the outer surface of the core material 52. Then, referring to FIG. 8B, a dead metal 52*a* area composed of the core material 52 which fails to flow into the die opening 11 is formed in the vicinity of the die 3, although the area is narrow. As the die 3 is further forced to move, referring to FIG. 8C, the core material 52 in the vicinity of the dead metal 52*a* area is extruded through the die opening 11 as a product surface layer 62. As a result, an extruded material 60 makes a defective clad (three-layer clad) comprising a first layer composed of the core material 52 (product surface layer 62), a second layer 64 composed of the coating material 54 and a third layer 66 composed of the core material 52 (refer to FIGS. 8C and 8D which is a cross sectional view taken along a line 8D—8D of FIG. 8C).

SUMMARY OF THE INVENTION

An object of the present invention is to provide an indirect extrusion method which can substantially reduce a cut-off ratio of a defective clad and improve the product yield.

In order to attain the above object, the present invention provides an indirect extrusion method for manufacturing a clad material by indirect extrusion in which a die is forced to move relatively toward a billet set inside a container. The billet is composed of a cylindrical or tubular core material and a coating material coating the outer surface of the core material. A billet thrusting face of the die is tapered at an angle of 55–85 degrees with regard to the axis of the die. To an end of the billet, a circular or annular front plate made of the same material as the coating material is attached, and the plate is extruded together with the billet.

According to the above indirect extrusion method for a clad material (hereinafter, referred to merely as indirect extrusion method), as extrusion processing is performed, the front plate provided at the head of the billet flows out first. Therefore, dead metal composed of the front plate instead of the core material is formed. Since the front plate is made of the same material as the coating material, generation of a three-layer clad is avoided. Additionally, since the billet thrusting face is tapered at an angle of 55–85 degrees with regard to the axis of the die, the volume of the dead metal itself is reduced. Therefore, a defective clad, even if it is generated, can be driven out at an early stage of extrusion. If the angle of the billet thrusting face with regard to the axis of the die (hereinafter, referred to as taper angle) is more than 85 degrees, there is no improvement in reduction of the dead metal volume. If the taper angle is less than 55 degrees, part of the billet is adhered to the billet thrusting face of the die upon cutting off the extruded remainder. Therefore, removal of the adhesion part is necessary at completion of extrusion, and this substantially decreases the workability.

In order to prevent a phenomenon (blister) in which a space is generated between the core material and the coating material in the extruded material manufactured according to the indirect extrusion method of the present invention and to improve the product yield, the indirect extrusion method can be performed under the following condition.

The second aspect of the indirect extrusion method for a clad material according to the present invention is that a diameter of the front plate is 90–100% of a diameter of the billet.

According to the above indirect extrusion method, a space between a peripheral corner of the front plate and the container is minimized. Additionally, since deformation of the coating material is prevented by the front plate, less air is caught at the time of extrusion and generation of a blister is thus avoided. In case that the front plate diameter is less than 90% of the billet diameter, the space between the peripheral corner of the front plate and the container is enlarged and the air is easily caught. This thus causes a blister. In case that the front plate diameter is more than 100% of the billet diameter, the front plate diameter is then larger than a diameter of the container, and there would be a trouble in fitting the front plate into the container.

The third aspect of the present invention is, in the indirect extrusion method for a clad material, that a thickness of the front plate is 5–20% of the billet diameter.

According to the above indirect extrusion method, generation of a defective clad (which is necessary to be removed from the product) at an early stage of extrusion is further avoided. If the front plate thickness is less than 5% of the billet diameter, dead metal composed of the core material is not effectively reduced, and it is likely that a four-layer clad (defective clad portion) composed of the front plate, core material, coating material and core material in layers is formed at an early stage of extrusion. If the front plate thickness is more than 20% of the billet diameter, a cladding ratio (i.e. a coating material thickness of the extruded material divided by a radius of the extruded material) at an early stage of extrusion becomes too high. As a result, an elongate portion with heavy coating is generated and the portion to be cut off is increased.

A mechanism in which a four-layer clad is generated at an early stage of extrusion is described hereafter. It should be noted that, in FIGS. 9A–9C used in the following description, the angle of a billet thrusting face 3*a* of the die 3 is not 55–85 degrees but 90 degrees with regard to an axis P of the die 3 (refer to FIG. 9A). Therefore, the description using these figures is not within a scope of the present invention. However, the similar mechanism applies to a case in which a four-layer clad is generated at an early stage of extrusion when the front plate thickness is set to less than 5% of the billet diameter as above.

As shown in FIG. 9A, a clad billet 70 comprises a core material 72, a coating material 74 coating the outer surface of the core material 72, and a front plate 76 provided at the head of the core material 72 and made of the same material as the coating material 74. In the clad billet 70, a thickness of the front plate 76 is small with regard to a diameter of the billet 70 (less than 5% of the diameter, for example).

As the die 3 is forced to move relatively toward the clad billet 70 constituted as above, the clad billet 70 is extruded through the die opening 11 into an extruded material 80 comprising a product surface 82 composed of the front plate 76 and a layer 84 composed of the core material 72 arranged inside the product surface 82, as shown in FIG. 9B. In this case, a dead metal 78 area including not only the front plate 76 but also the core material 72 is formed in the vicinity of the die 3 due to the thin front plate 76. As the die 3 is further forced to move, the core material 72 and the coating material 74 in the vicinity of the dead metal 78 area are respectively extruded in layers into the product surface 82 composed of the front plate 82, as shown in FIG. 9C. In other words, the product makes a defective clad (four-layer clad) comprising a first layer composed of the front plate 76 (product surface 82), a second layer 86 composed of the core material 72, a third layer 88 composed of the coating material 74 and a fourth layer 90 composed of the core material 72 (also refer to FIG. 9D which is a cross sectional view taken along with a line 9D—9D of FIG. 9C).

A mechanism in which the aforementioned elongate portion with heavy coating is generated is explained by way of FIGS. 10A and 10B. It should be noted that in FIGS. 10A and 10B, the angle of the billet thrusting face 3*a* of the die 3 is not 55–85 degrees but 90 degrees with regard to the axis P of the die 3 (refer to FIG. 10A). Therefore, the description using these figures is not within a scope of the present invention. However, the similar mechanism applies to a case in which the elongate portion with heavy coating is generated at an early stage of extrusion when the front plate thickness is set to more than 20% of the billet diameter as above.

FIG. 10A shows a clad billet having the same constitution with the clad billet of FIG. 9A (the same components as those in FIG. 9A are shown with the same reference numbers, and the descriptions are omitted). In the billet 70, the thickness of the front plate 76 is large with regard to the diameter of the billet 70 (more than 20% of the diameter, for example).

As the die 3 is forced to move toward the clad billet 70 constituted as above, a dead metal 79 area comprising essentially the front plate 76 is formed in the vicinity of the die 3, as shown in FIG. 10B, due to the considerably thick front plate 76. An extruded material 81 comprises a product surface layer 83 composed of the front plate 76 or the coating material 74, and a layer 85 composed of the core material 72 arranged inside of the product surface player 83. When the thickness of the front plate 76 is large with regard to the diameter of the billet 70, however, a cladding ratio of the extruded material 81 becomes higher than the desired value at an early stage of extrusion. Therefore, an elongate portion 81*a* with heavy coating, which is to be cut off, is generated.

In the fourth aspect of the indirect extrusion method for a clad material according to the present invention, the outer surface of the front plate is in the form of a cone which is fitted along the taper of the die.

According to the indirect extrusion method as above, the space between the front plate and the die is reduced. Therefore, it is effective to prevent generation of a blister.

BRIEF DESCRIPTION OF THE DRAWINGS

The invention will now be described, by way of an example, with reference to the accompanying drawings, in which:

FIGS. 8A–8D are explanatory views illustrating a mechanism on how a defective clad called three-layered clad is formed;

FIGS. 9A–9D are explanatory views illustrating a mechanism on how a defective clad called four-layered clad is formed.

DESCRIPTION OF THE PREFERRED EMBODIMENT

Figure 1:
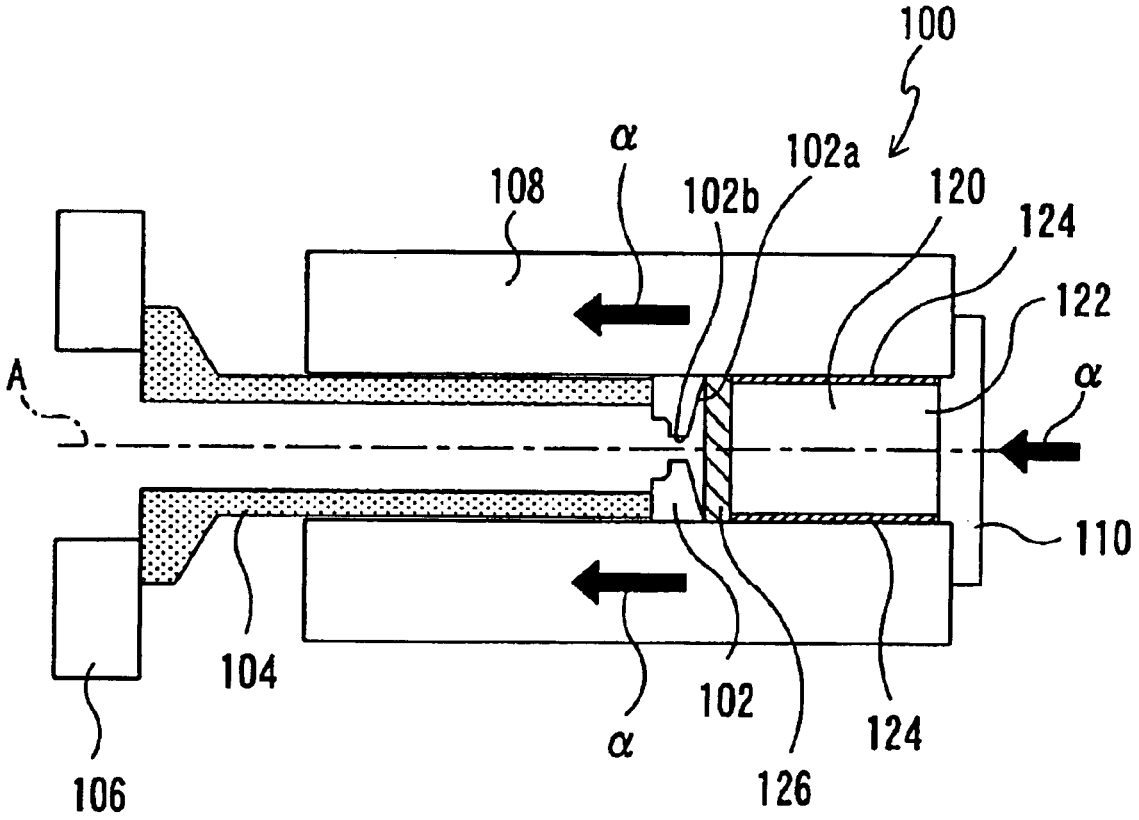
FIG. 1 is an explanatory view illustrating a schematic constitution of an indirect extrusion mechanism used in an indirect extrusion method according to the present invention.

FIG. 1 is an explanatory view showing a schematic constitution of an indirect extrusion mechanism 100 used in an indirect extrusion method according to an embodiment of the present invention.

In this mechanism 100, a die 102 which defines an outer shape of an extruded material is fitted inside a container 108, being thrust by a platen 106 via a die-stem 104. A closing plate 110 facing the die 102 is attached to an end of the container 108. A clad billet 120 is arranged inside the container 108 between the die 102 and the closing plate 110, to be served in indirect extrusion processing.

In this case, the die 104 is forced to move relatively toward the clad billet 120 set inside the container 108 so that the billet 120 inside the container 108 is pressurized by a billet thrusting face 102*a* to be extruded through a die opening 102*b* as an extruded material.

In the present embodiment, the indirect extrusion processing is performed by moving a set of container 108, closing plate 110 and clad billet 120 together toward a direction of the die 104 (direction of an arrow α in FIG. 1).

Figures 2A, 2B:
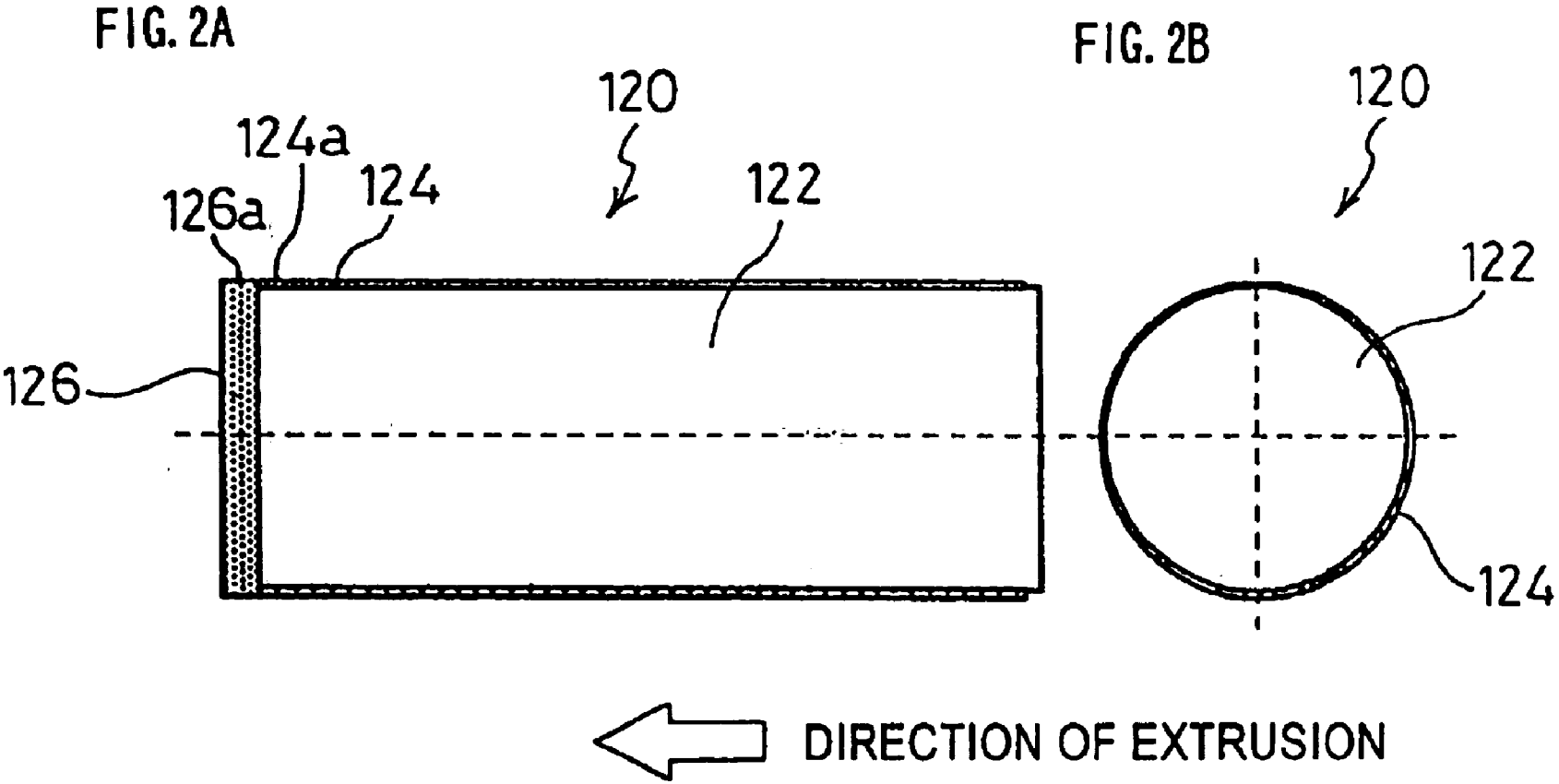
FIGS. 2A and 2B are explanatory views of a clad billet used in the indirect extrusion method according to the present invention.

The clad billet 120 is now described by way of FIGS. 2A and 2B. FIGS. 2A and 2B are explanatory views of the clad billet 120. FIG. 2A is the cross sectional view and FIG. 2B is the side view. As can be seen from the figures, an outer surface of a cylindrical core material 122 of the clad billet 120 is coated with a tubular coating material 124. A circular front plate 126 is provided at the head of the clad billet 120 (with which the billet thrusting face 102*a* is in first contact upon extrusion). The front plate 126 is made of the same material as the coating material 124.

Figure 3A:
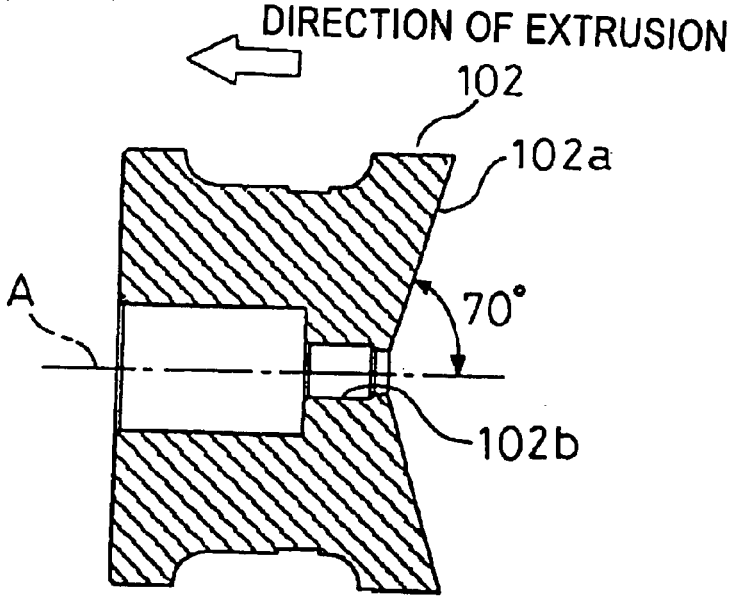
FIGS. 3A–3C are explanatory views of a die used for evaluating the indirect extrusion method according to the present invention.

FIG. 3A shows an example of the die 102 used in the present indirect extrusion method. As shown in the figure, the billet thrusting face 102*a* of the die 102 is tapered at an angle of 70 degrees with regard to an axis A of the die 102.

Figure 3B:
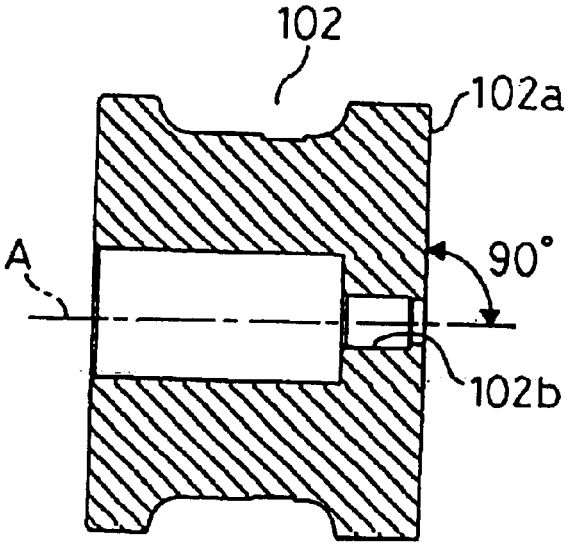
Figure 3C:
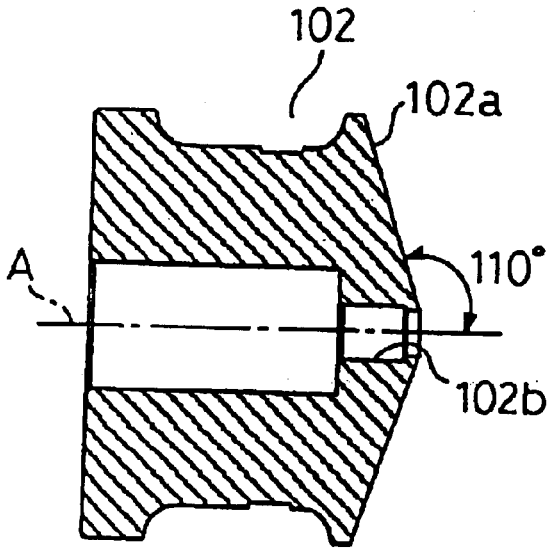
Figure 4:
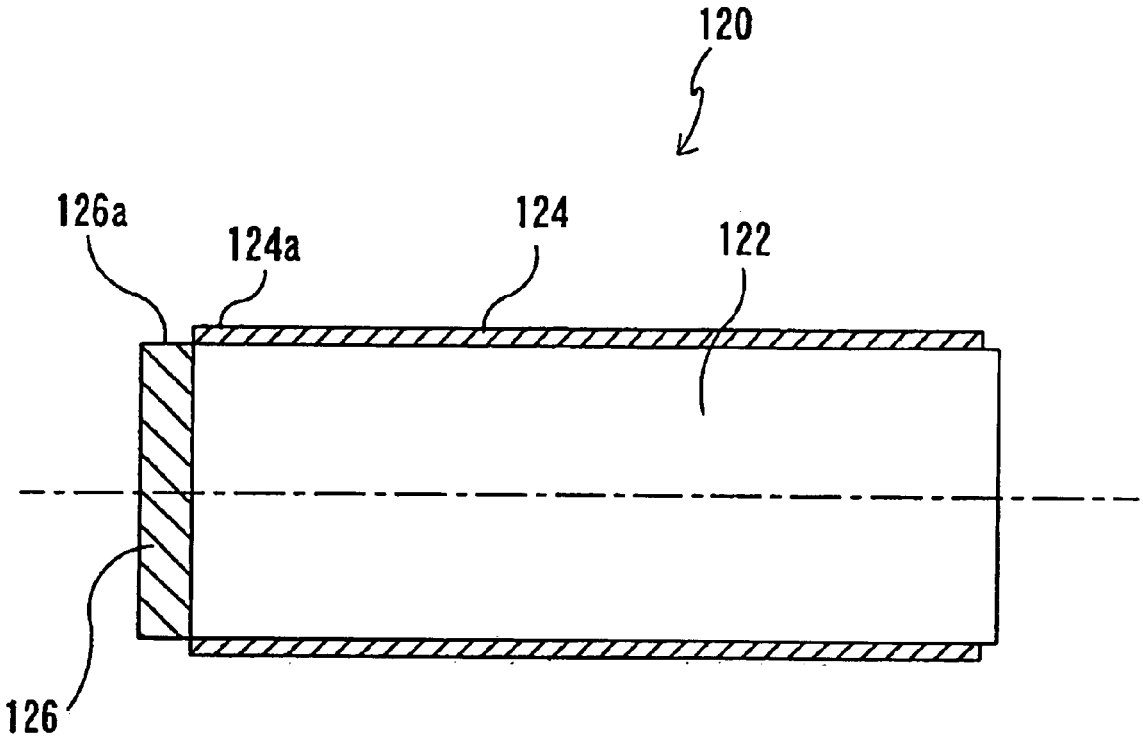
FIG. 4 is an explanatory view illustrating an example in which a diameter of a front plate is less than a diameter of the clad billet.

Extrusion processing using the above described clad billet 120 and die 102 was performed and the results of the processing are described below. For comparison, a number of extrusion processing were also performed, varying a taper angle of the thrusting face 102*a* of the die 102, and a thickness as well as a diameter of the front plate 126. FIGS. 3B and 3C show examples of dies used in the comparative examples, and the taper angles of the dies are 90 degrees and 110 degrees, respectively. The core material 122 used is made of JISA3003 and is cylindrical, having a diameter of 92 mm and a length of 300 mm. The coating material 124 used is made of JISA1070, and an outer diameter, an inner diameter and a length of the coating material 124 are 100 mm, 92 mm and 295 mm, respectively. FIG. 2A shows the front plate 126 of which diameter is equal to a diameter of the billet 120. FIG. 4 shows the front plate 126 of which diameter is less than the diameter of the billet 120. In both cases shown in FIGS. 2A and 4, a peripheral corner 126*a* of the front plate 126 and a front end 124*a* of the coating material 124 are firmly stuck, ex. welded, to each other for convenience of positioning, before the billet 120 is set inside the container.

Visual observation on a blister was conducted throughout the length of the product after extrusion, and a length of a defective clad portion (portion made of the front plate only, portion having a too much cladding ratio due to the front plate, and a portion comprising four layers composed of the front plate, core material, coating material and core material) was measured. Table 1 shows results of evaluation along with parameters of the prepared examples and comparative examples.

TABLE 1

| | taper angle | front plate diameter/ billet diameter | front plate thickness | blister | | bad clad lengh |
|---|---|---|---|---|---|---|
| | (°) | (%) | (mm) | Y/N | level | (m) |
| Comp. Ex. 1 | 50 | 100 | 10 | Y | L | 0.8 |
| Example 1 | 55 | 100 | 10 | N | — | 0.8 |
| Example 2 | 60 | 100 | 10 | N | — | 0.7 |
| Example 3 | 60 | 80 | 10 | Y | L | 1.0 |
| Example 4 | 70 | 90 | 4 | N | — | 3.0 |
| Example 5 | 70 | 90 | 5 | N | — | 1.0 |
| Example 6 | 70 | 95 | 10 | N | — | 0.5 |
| Example 7 | 70 | 100 | 15 | N | — | 0.9 |
| Example 8 | 80 | 100 | 18 | N | — | 1.0 |
| Example 9 | 80 | 100 | 20 | N | — | 1.0 |
| Example 10 | 80 | 100 | 23 | Y | S | 4.2 |
| Example 11 | 85 | 100 | 10 | N | — | 1.0 |
| Comp. Ex. 2 | 90 | 100 | 4 | Y | S | 5.5 |
| Comp. Ex. 3 | 90 | 100 | 10 | Y | S | 5.1 |
| Comp. Ex. 4 | 100 | 100 | 10 | Y | S | 7.7 |

As can be seen from the table, the length of the defective clad portion was equal to or less than 5 m in the first example in which the taper angle is 55 degrees, the second and third examples in which the taper angle is 60 degrees, the fourth to seventh examples in which the taper angle is 70 degrees, the eighth to tenth examples in which the taper angle is 80 degrees, and the eleventh example in which the taper angle is 85 degrees. The length of the defective clad portion is favorably shortened.

On the other hand, although the length of the defective clad portion was 0.8 m in the first comparative example in which the taper angle is 50 degrees, there was a conspicuous blister (level: large) which cannot be corrected. Furthermore, part of the billet 120 was adhered to the billet thrusting face 102*a* of the die 102 when the extruded remainder of the billet 120 was cut off. It took more time than expected to remove the adhesion part after extrusion, and therefore, the workability was determined poor.

The length of the defective clad portion was more than 5 m in the second and third comparative examples in which the taper angle is 90 degrees and in the fourth comparative example in which the taper angle is 110 degrees. These examples failed to shorten the length of the defective clad portion.

Among the first to eleventh examples, no blister is generated in the first, second, seventh to ninth and eleventh examples in which a diameter of the front plate 126 is equal to a diameter of the clad billet 120, in the fourth and fifth examples in which the diameter of the front plate 126 is 90% of the diameter of the clad billet 120, and in the sixth example in which the diameter of the front plate 126 is 95% of the diameter of the clad billet 120. In the tenth example in which the diameter of the front plate 126 is equal to the diameter of the clad billet 120, a blister was generated but small enough to be corrected.

In the third example in which the diameter of the front plate 126 is 80% of the diameter of the clad billet 120, however, a blister so large as cannot be corrected was generated. This is because there was a large space left between the container 108 and the front plate 126 in the third example. In other words, the air was caught between the coating material 124 and the core material 122 during extrusion due to the large space, and it resulted in generation of a large blister.

Among the first to eleventh examples, the length of the defective clad portion was equal to or less than 1 m in the first to third, sixth and eleventh examples in which the thickness of the front plate 126 is 10 mm (10% of the 100 mm diameter of the clad billet 120), in the fifth example in which the thickness is 5 mm, in the seventh example in which the thickness is 15 mm, in the eighth example in which the thickness is 18 mm, and in the ninth example in which the thickness is 20 mm. The length of the defective clad portion was further shortened.

In the fourth example in which the thickness of the front plate 126 is 4 mm, however, the length of the defective clad portion was more than 1 m, that is, 3.0 m. This is because the front plate 126 was too thin. The thin front plate 126 failed to reduce the volume of dead metal composed of the core material 122, and thus a four-layer clad was formed at an early stage of extrusion.

In the tenth example in which the thickness of the front plate 126 is increased to 23 mm, a cladding ratio at an early stage of extrusion was too high, and a portion with heavy coating (defective clad portion) was generated.

From the above, it was found that, in order to favorably shorten the length of the defective clad portion upon manufacturing a clad material, the taper angle is preferably set to 55–85 degrees. In addition to setting the taper angle to 55–85 degrees, in order to further prevent generation of a blister, it was found that the diameter of the front plate 126 is preferably set to 90–100% of the diameter of the billet 120. In addition to setting the taper angle to 55–85 degrees, in order to further shorten the length of the defective clad portion, it was found that the thickness of the front plate 126 is preferably set to 5–20% of the diameter of the billet 120.

Although a preferred embodiment of the present invention has been described, it is to be clearly understood that the invention may be embodied in a variety of ways.

For instance, the outer surface of the front plate 126 may be in the form of a cone which is fitted along the taper of the thrusting face 102*a* of the die 102. Since the space between the front plate 126 and the die 102 is reduced, it is effective in avoiding generation of a blister.

Figure 5:
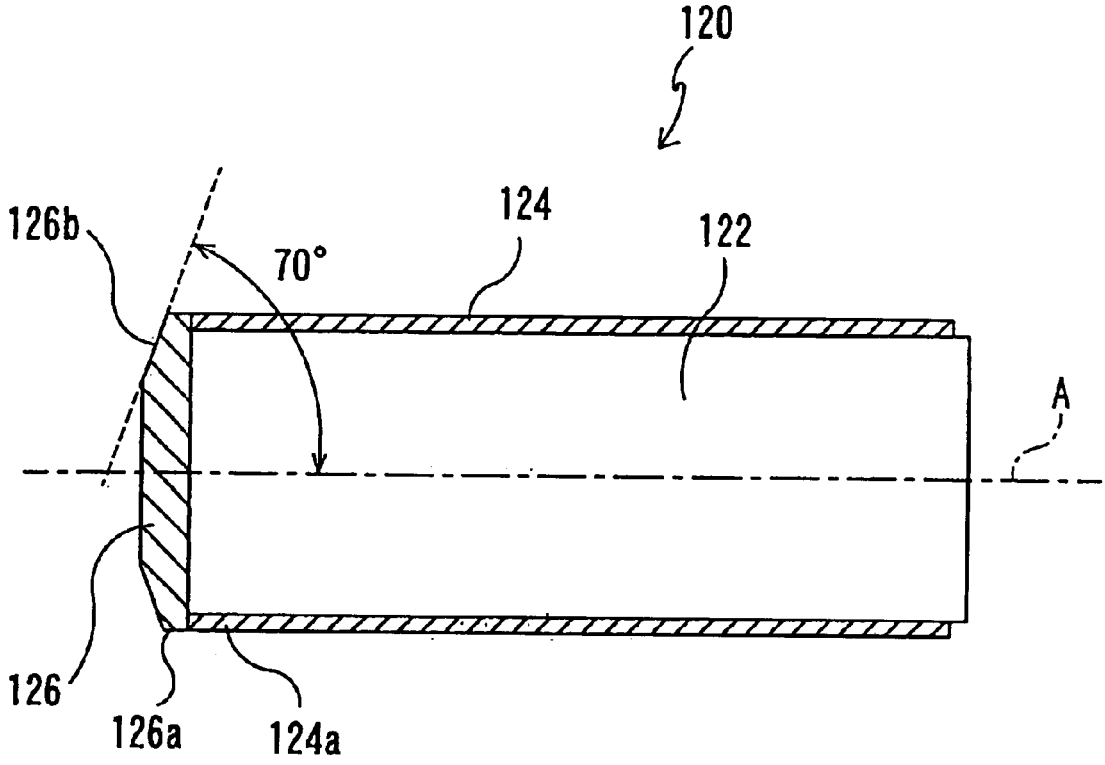
FIG. 5 is an explanatory view illustrating an example in which an outer surface of the front plate is in the form of a cone.

FIG. 5 shows an example in which the outer surface 126*b* of the front plate 126 is in the form of a cone. In FIG. 5, the angle of the outer surface 126*b* with regard to the axis A is set to 70 degrees so that it fits to a case that the thrusting face 102*a* of the die 102 is tapered at an angle of about 70 degrees with regard to the axis A of the die 102.

Figure 6:
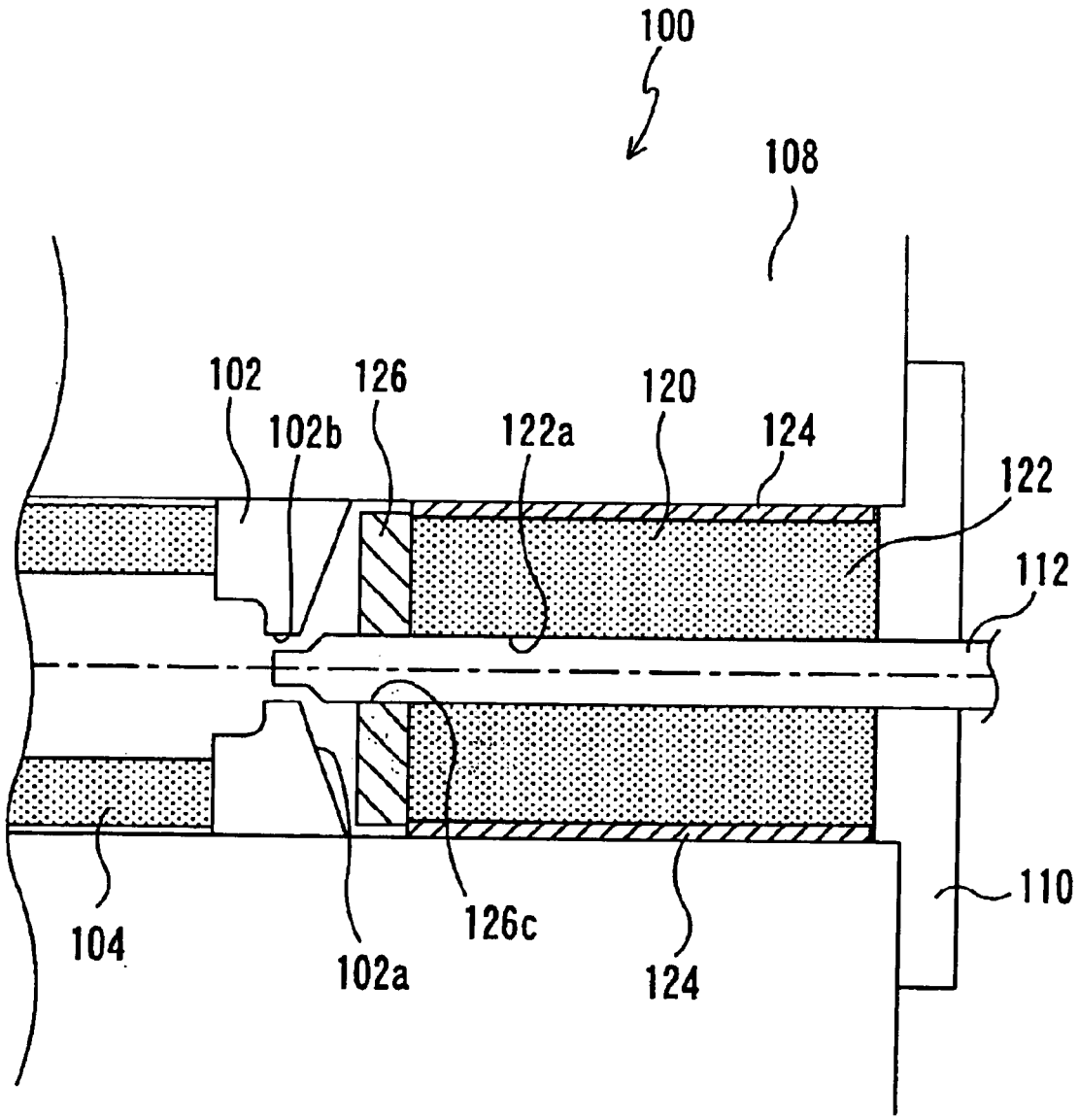
FIG. 6 is an explanatory view illustrating a schematic constitution of the indirect extrusion mechanism in which a mandrel is arranged inside a container.
Figure 7:
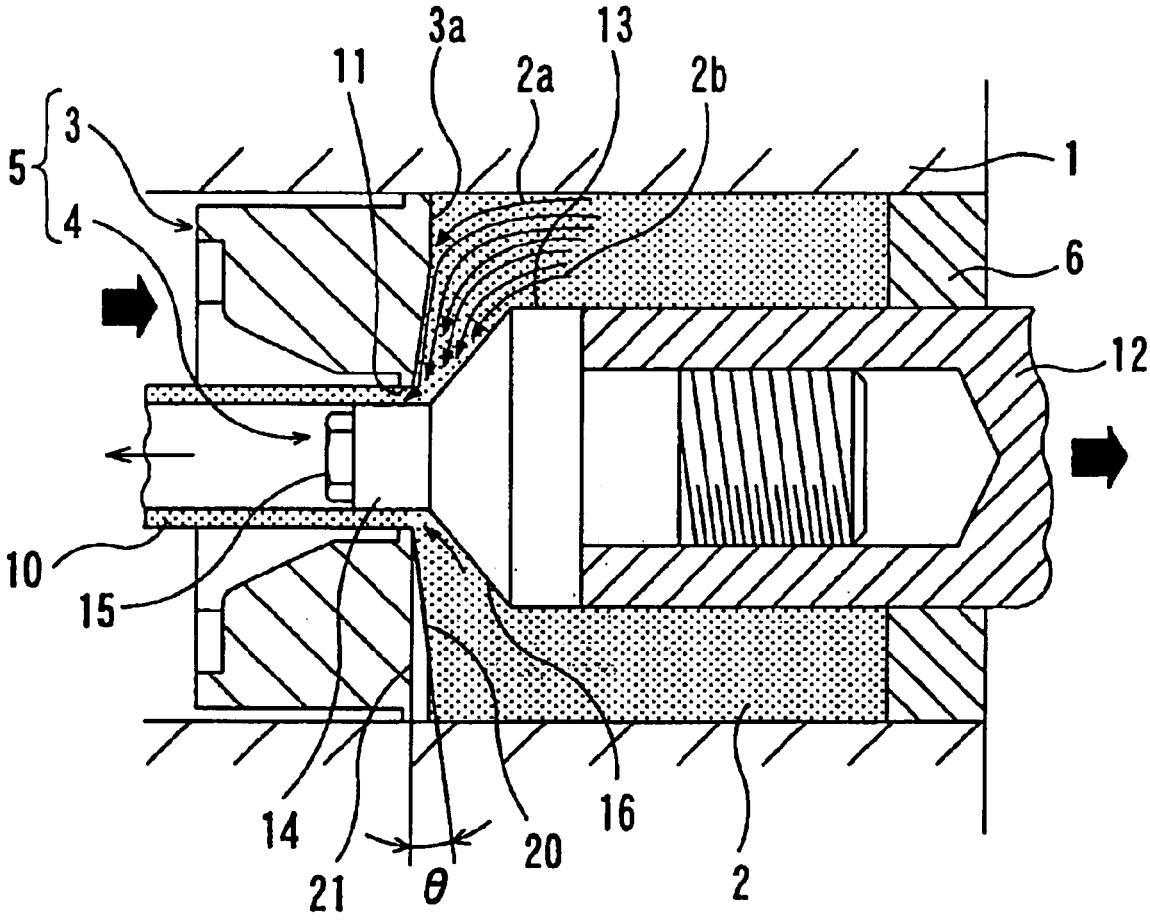
FIG. 7 is an explanatory view illustrating a schematic constitution of a conventional indirect extrusion mechanism.
Figure 10A:
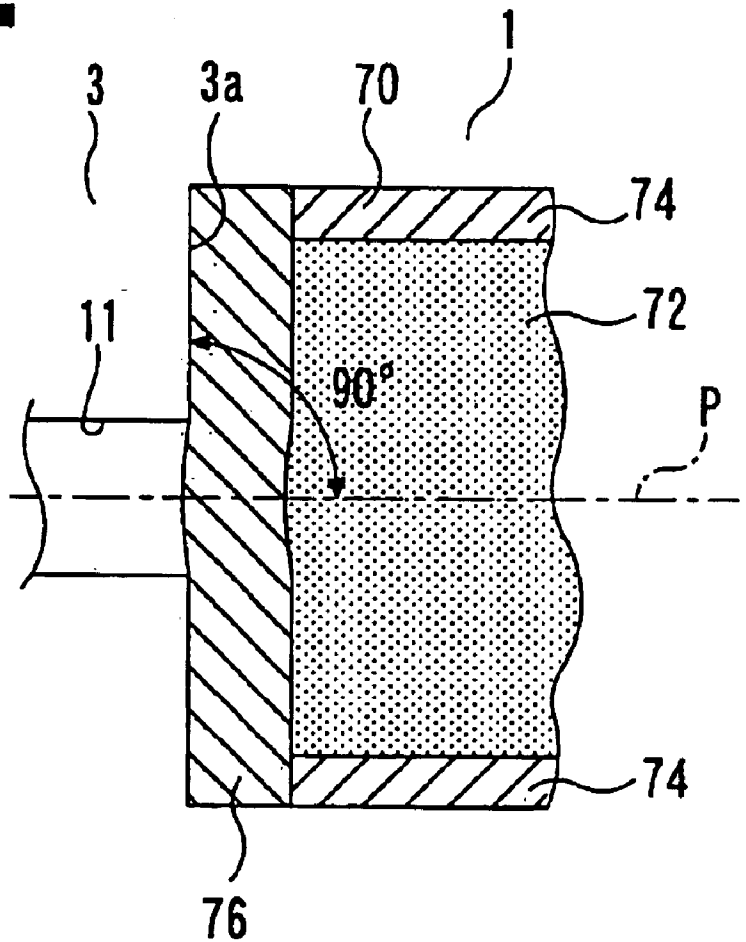
FIGS. 10A and 10B are explanatory views illustrating a mechanism on how a defective clad called a portion with heavy coating is formed.
Figure 10B:
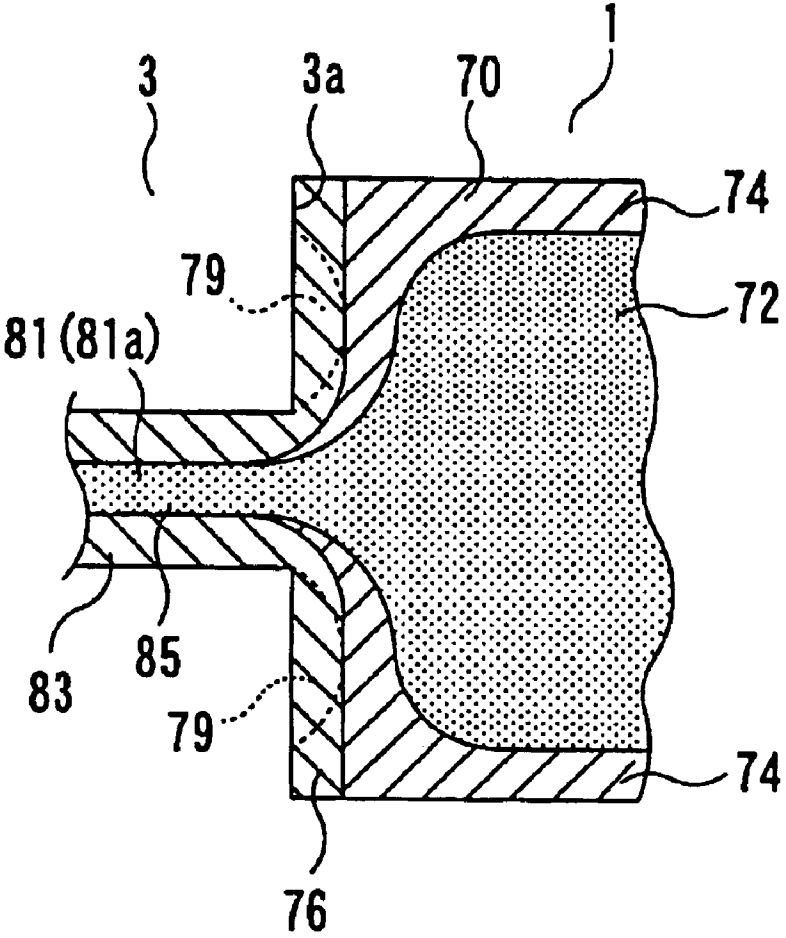

As shown in FIG. 6, the clad billet 120 may be hollowed. By arranging the mandrel 112 piercing the billet 120 inside the container 108, and moving the die 102 and the mandrel 112 relatively toward the billet 120 upon indirect extrusion, a clad material (extruded material) in the form of a pipe may be obtained from the die opening 102*b*.

In this case, the core material 122 is in the form of a tubular member having a piercing hole 122*a* extending toward the axial direction. In addition, the front plate 126 is in the form of a ring having a piercing hole 126*c* extending toward the axial direction. As shown in FIG. 6, a diameter of the piercing holes 122*a* and 126*c* corresponds to a diameter of the mandrel 112.

What is claimed is:

1. An indirect extrusion method for manufacturing a solid clad material formed from billet comprising a cylindrical material and a coating material coating an outer surface of the core material, the method comprising the steps of:

preparing a die with a billet thrusting face tapered at an angle of substantially 55–85 degrees with regard to the axis of the die;

providing a circular front plate of the same material as the coating material to a top end of the billet; and extruding the front plate together with the billet via indirect extrusion in which the die is forced to move relatively toward the billet set inside a container to form the solid clad material.

2. The indirect extrusion method of a clad material set forth in claim 1, wherein a diameter of said front plate is 90–100% of a diameter of said billet.

3. The indirect extrusion method of a clad material set forth in claim 1, wherein a thickness of said front plate is 5–20% of a diameter of said billet.

4. The indirect extrusion method of a clad material set forth in claim 1, wherein an outer surface of said front plate is in the form of a cone fitted along the taper of said die.

5. An indirect extrusion method for manufacturing a hollow clad material formed from a billet comprising a tubular core material and a coating material coating an outer surface of the core material, the method comprising the steps of:

preparing a die with a billet thrusting face tapered at an angle of substantially 55–85 degrees with regard to the axis of the die;

providing an annular front plate of the same material as the coating material to a top end of the billet; and extruding the front plate together with the billet via indirect extrusion in which the die is forced to move relatively toward the billet set inside a container to form the hollow clad material.

6. The indirect extrusion method of a clad material set forth in claim 5, wherein a diameter of said front plate is 90–100% of a diameter of said billet.

7. The indirect extrusion method of a clad material set forth in claim 5, wherein a thickness of said front plate is 5–20% of a diameter of said billet.

8. The indirect extrusion method of a clad material set forth in claim 5, wherein an outer surface of said front plate is in the form of a cone fitted along the taper of said die.

9. An indirect extrusion method for manufacturing a clad material formed from a billet comprising a cylindrical or tubular core material and a coating material coating an outer surface of the core material, the method comprising the steps of:

preparing a die with a billet thrusting face tapered at an angle of substantially 55–85 degrees with regard to the axis of the die;

providing a circular or annular front plate of the same material as the coating material to a top end of the billet; and extruding the front plate together with the billet via indirect extrusion in which the die is forced to move relatively toward the billet set inside a container to form the clad material.

* * * * *